United States Patent [19]

Sugiyama et al.

[11] 4,284,345

[45] Aug. 18, 1981

[54] BLADE-TYPE CLEANING DEVICE FOR ELECTROPHOTOGRAPHIC COPYING MACHINE

[75] Inventors: Takashi Sugiyama; Masaya Ogawa, both of Osaka; Hiroshi Murasaki, Sakai, all of Japan

[73] Assignee: Minolta Camera Kabushiki Kaisha, Osaka, Japan

[21] Appl. No.: 71,794

[22] Filed: Aug. 31, 1979

[30] Foreign Application Priority Data

Sep. 19, 1978 [JP] Japan ..... 53-115256
Sep. 19, 1978 [JP] Japan ..... 53-115257
Apr. 13, 1979 [JP] Japan ..... 54-50010[U]

[51] Int. Cl.[3] ..... G03G 21/00
[52] U.S. Cl. ..... 355/15; 355/3 R
[58] Field of Search ..... 355/3 R, 15; 15/256.51, 15/256.52

[56] References Cited

U.S. PATENT DOCUMENTS 3,660,863 5/1972 Gerbasi ..... 355/15
3,871,762 3/1975 Van Der Vlasakker ..... 355/15
4,026,648 5/1977 Takahashi ..... 355/15
4,056,315 11/1977 Ariyama et al. ..... 355/15 X
4,166,692 9/1979 Okada et al. ..... 355/14 R

*Primary Examiner*—Fred L. Braun
*Attorney, Agent, or Firm*—Wenderoth, Lind & Ponack

[57] ABSTRACT

An electrophotographic copying apparatus has a frame with two portions which are movable away from each other. An electrophotographic photoconductive member is mounted on one of the frame portions for being exposed when the frame portions are moved away from each other to enable the member to be removed from the frame. A blade-type cleaning device is provided having an elastic blade member for contacting the surface of the electrophotographic photoconductive member for removing residual toner from the surface during movement of the member and a blade holder holding the blade member and mounted on the one frame portion for movement toward and away from the surface of the electrophotographic photoconductive member. A spring is connected to the holder for biasing the holder to urge the blade member into contact with the surface when the frame portions are together. A retracting device is connected to the cleaning device for retracting the holder from the surface when the frame portions are moved away from each other.

13 Claims, 13 Drawing Figures

BLADE-TYPE CLEANING DEVICE FOR ELECTROPHOTOGRAPHIC COPYING MACHINE

BACKGROUND OF THE INVENTION

1. Field of the Invention

The present invention relates to a blade-type cleaning device for transfer-type electrophotographic copying machines, and more particularly to a blade-type cleaning device comprising a blade member of elastic material which is placed in pressing contact with the surface of a photoconductive member to remove residual toner from the surface.

2. Description of the Prior Art

Blade-type cleaning devices heretofore known can be divided into two general groups, those in which, as shown in FIG. 1, of the two angles between the blade member 61 and line $X_1$ tangent to the point of contact $C_1$ between the blade member 61 and a photoconductive member 2 rotatable in the direction of the arrow a, the angle (hereinafter referred to as "contact angle") $\theta_1$ on the uncleaned portion of the photoconductive member 2 moving toward the blade is an obtuse angle, and those in which as shown in FIG. 2, the contact angle $\theta_2$ between the blade member 61 and the tangent $X_2$ to the contact point $C_2$ is an acute angle.

In the arrangement shown in FIG. 1 in which the blade member 61 presses against the surface of the photoconductive member 2 at an obtuse contact angle $\theta_1$, the frictional force between the photoconductive surface and the blade member 61 tends to compress the blade member and deforms the blade member 61 transversely of the axis thereof, so that the contact point $C_1$ is subjected to a very great force. When rotation of the photoconductive member 2 is initiated, an especially high frictional force acts, and there is a possibility that the photoconductive member will be damaged.

The blade member 61 of FIG. 2 is not subjected to a friction force which tends to compress it, so that the possibility of this type of damage is not present. The arrangement of FIG. 2 nevertheless is deficient as compared with that of FIG. 1 in that the cleaning force is smaller and the blade member is likely to leave some residual toner on the photoconductive member depending on the angular setting of the blade member 61.

Furthermore the blade member of the cleaning device of the types described is held in contact with the surface of the photoconductive member at a pressure sufficient to remove fine toner particles from the surface. The cleaning effect achieved depends largely on this pressure, the angle of contact between the blade member and the photoconductive member, etc. Thus the blade member must be set relative to the photoconductive member with high accuracy.

On the other hand, the photoconductive member of electrophotographic copying machines is generally detachable from the main body of the machine as a unit to permit replacement, but if the blade member is in pressing contact with the surface of the photoconductive member, it is very disadvantageous for detaching or installing the photoconductive member.

For example, when the photoconductive member is a drum-shaped member which is movable axially thereof for removal and installation, the blade member will mar the photoconductive surface when it is in pressing contact therewith. The photoconductive member requires a considerable force for installation if the blade member is set at a certain angle or will be improperly deflected by the pressure of the blade member.

SUMMARY OF THE INVENTION

This invention improves the conventional blade-type cleaning devices, and more particularly improves the blade-type cleaning devices of the type shown in FIG. 2 in which the contact angle $\theta$ is an acute angle.

More specifically stated, the main object of the invention is to provide a blade-type cleaning device comprising an elastic blade member which is normally in pressing contact with the surface of an electrophotographic photoconductive member for removing residual toner from the surface thereof during the movement of the photoconductive member and holder means holding the blade member and turnable about a support point to bring the blade member into or out of contact with the surface, the blade member being initially set at an angle $\theta$ corresponding to $65° \leqq \theta \leqq 85°$ on the uncleaned side of the surface with respect to a tangent to the surface through the point of contact between the blade member and the surface, the blade member being positioned at an angle $\alpha$ corresponding to $0° \leqq \alpha \leqq 90°$ on the uncleaned side of the surface with respect to a line through the support point and the point of contact between the blade member and the surface.

Another object of the invention is to provide a blade-type cleaning device incorporating a mechanism for retracting the blade member from the photoconductive member while the photoconductive member is being mounted or removed to eliminate the drawbacks described above.

Still another object of the invention is to provide a blade-type cleaning device in which the cleaning device and a frame for mounting the photoconductive member are assembled into a frame structure to make it easy to set the blade member and the photoconductive member in position relative to each other.

BRIEF DESCRIPTION OF THE DRAWINGS

FIG. 4 (*b*) is a perspective view showing a torsion bar;

FIG. 6 (*b*) is a similar view showing the safety mechanism in its closed state;

DESCRIPTION OF THE PREFERRED EMBODIMENTS

Figure 3:
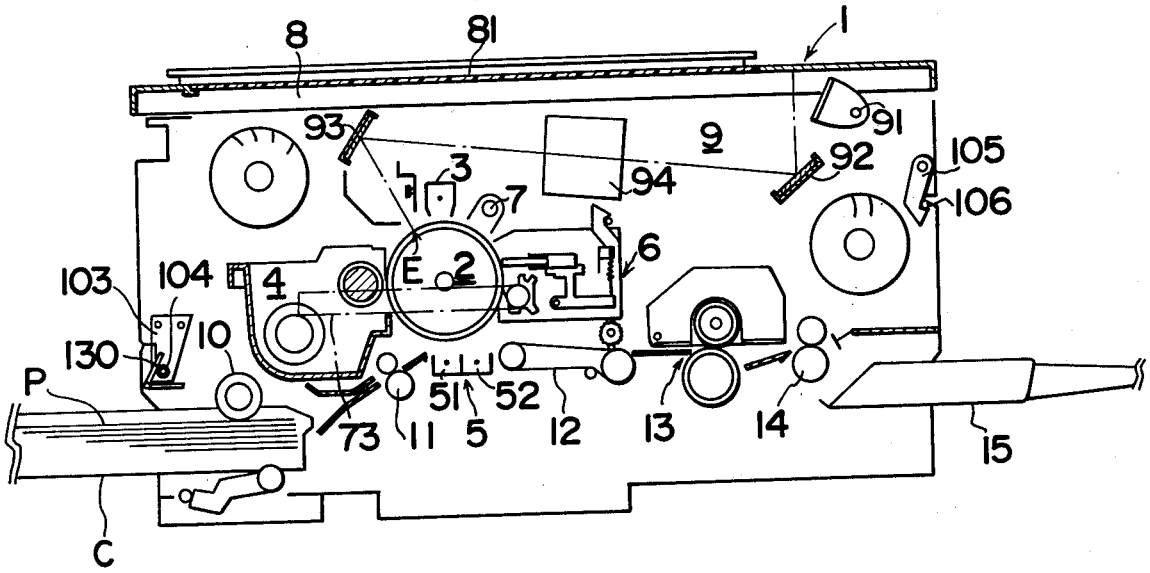
FIG. 3 is a sectional view showing an electrophotographic copying machine incorporating a blade-type cleaning device according to this invention.

In an electrophotographic copying machine 1 as shown in FIG. 3, there are disposed around a rotatably mounted photoconductive drum 2 a sensitizing charger 3, a developing unit 4, a transfer and erasing charger 5, a cleaner unit 6, an eraser lamp 7, etc. which are arranged in the described order.

A carriage 8 for carrying an original is movably mounted on the top of the copying machine main body for reciprocal movement therealong and has a support plate 81 made of transparent material for supporting an original (not shown) thereon. The original is scanned by an optical system 9 disposed below the carriage 8 and comprising an exposure lamp 91, reflecting mirrors 92 and 93, a lens 94, etc. The image of the original is projected at an exposure station E onto the surface of the photoconductive drum 2 during rotation of the drum.

Sheets of copy paper P are accommodated in a stack in cassette C and are fed by the rotation of a feed roller 10 one by one from the top of the stack. Each sheet is temporarily stopped by a timing roller unit 11 and is thereafter fed to the drum 2 in timed relation with the toner image formed on the photoconductive surface, whereupon the toner image is transferred to the sheet by the transfer charger 51. The sheet is then separated from the drum 2 by the erasing charger 52 and fed by a conveyor belt 12 to a heat roller fixing unit 13, where the toner image is fixed. The sheet is thereafter delivered onto a tray 15 by discharge rollers 14.

Figure 4A:
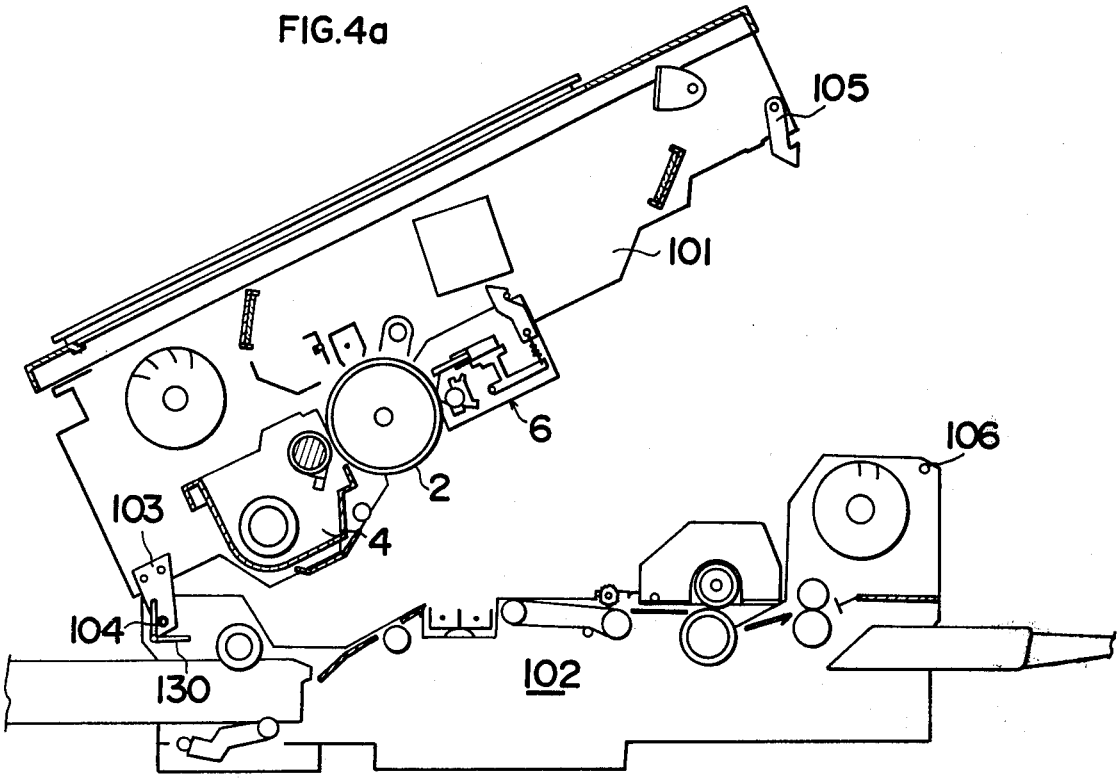
FIG. 4 (*a*) is a view showing the copying machine of FIG. 3 with the upper frame raised away from the lower frame.
Figure 4B:
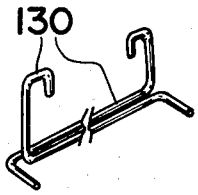

As seen in FIG. 4 (*a*), the main body frame of the copying machine 1 briefly described above is divided into an upper frame 101 and a lower frame 102 along the path of transport of the sheets of paper P. The two frames are connected together by support plates 103. The upper frame 101 is turnable about a pivot 104 relative to the lower frame 102.

The main body is thus openable so that a sheet P, when jammed at some point along the path of transport, is easily removable from the path. The photoconductive drum and the cleaner unit 6 are also mounted on the upper frame 101 and separated from the lower frame when the upper frame 101 is raised as shown in FIG. 4 (*a*). The upper and the lower frames 101 and 102 may be biased in the opening direction, for example by a torsion bar 130, and the frames are locked in the closed position by the engagement of a hook lever 105 on the upper frame 101 with a pin 106 fixed to the lower frame 102. The torsion bar 130, shaped as shown in FIG. 4 (*b*), facilitates opening of the upper frame 101. Such biasing means can be used when desired.

Figure 5:
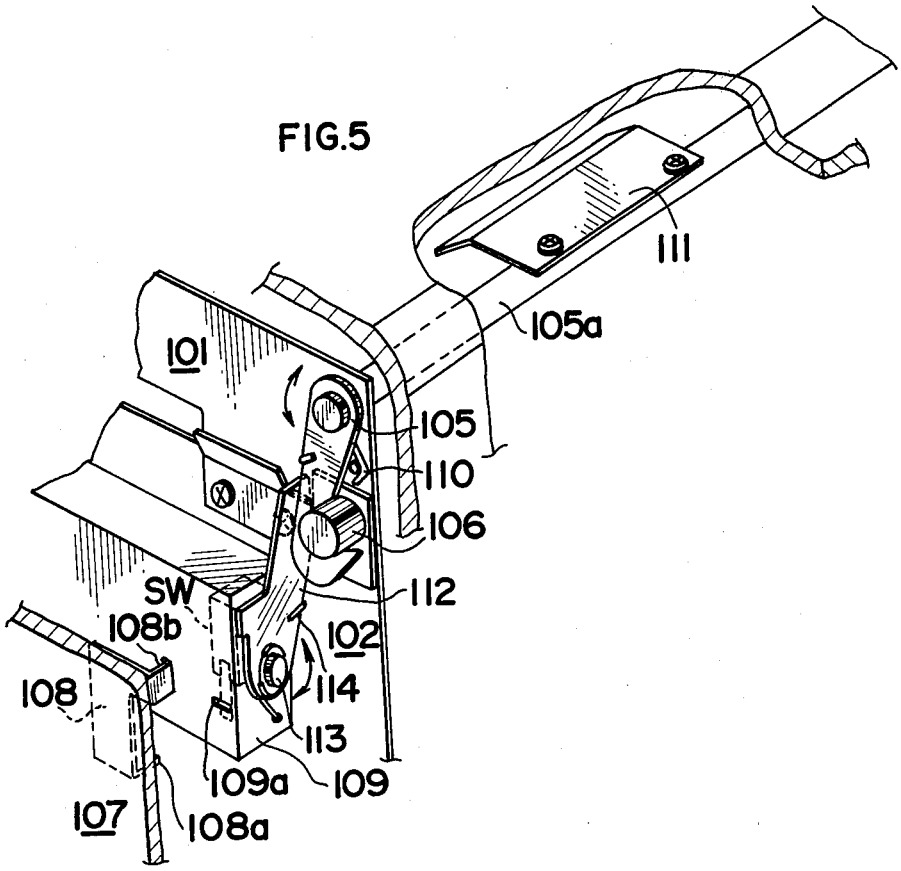
FIG. 5 is a fragmentary perspective view showing a safety mechanism included in the copying machine.

The electrophotographic copying machine 1 is equipped with a safety mechanism which is shown in FIG. 5 and FIGS. 6 (*a*) and (*b*) and which is associated with the locking means.

Figure 6A:
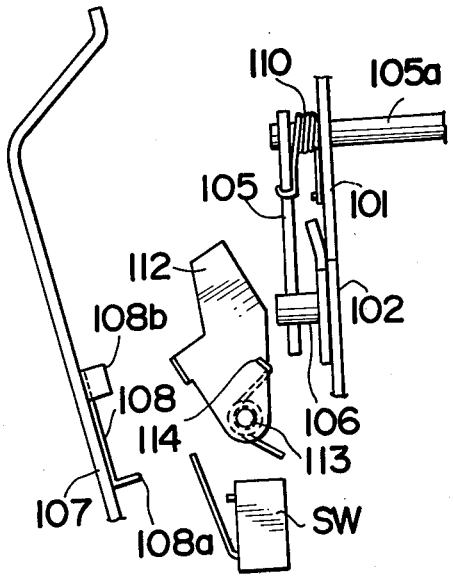
FIG. 6 (*a*) is a side elevation showing the safety mechanism in its opened state.
Figure 6B:
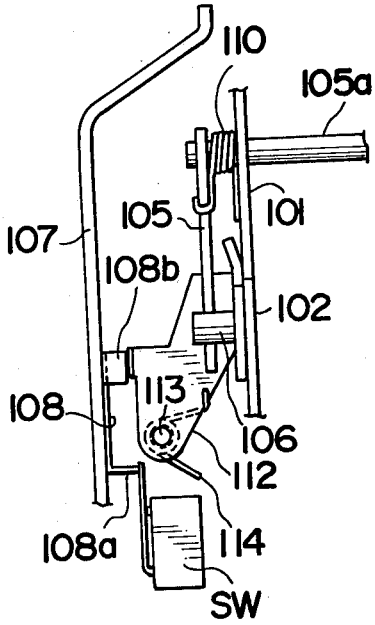

In machines such as copying machines, the main body is usually provided with a side panel which can be opened for the inspection of the interior or replacement of expendable material or for other purposes and which, when opened, operates a safety switch to open the power supply circuit or the like. The copying machine 1 described above also has provided on the upper frame 101 a microswitch SW in combination with an actuating member 108 fixed to an outer cover 107 and having a switch actuating piece 108*a* thereon. The switch actuating piece 108*a* is inserted into an aperture 109*a* in a cover 109 for the switch SW, when the outer cover 107 is held closed to keep the microswitch SW actuated, closing the power supply circuit (not shown). The hook lever 105 is fixed to one end of a rod 105*a* rotatably mounted on the upper frame 101 and biased by a torsion spring 110 counterclockwise in FIG. 5. The hook lever 105 is disengaged from the pin 106 by manipulating an unlocking plate 111 secured to the rod 105*a*. However, an attempt to pivot the upper frame 101 to the raised position, if made when the outer cover is closed, will cause damage to the actuating member 108 as well as to the outer cover 107 itself, and is also very objectionable from the standpoint of safety. To prevent this, therefore, the hook lever 105 is blocked from turning to prevent the upper frame 101 from being raised while the outer cover 107 is closed. With reference to FIG. 5 and FIGS. 6 (*a*) and (*b*), a restraining plate 112 is pivotally supported on a pin 113 on a side face of the switch cover 109 and is urged clockwise in FIG. 5 by another actuating piece 108*b* of the actuating member 108 to block the hook lever 105 from turning counterclockwise while the outer cover 107 is closed. The restraining plate 112, is biased by a torsion spring 114 to turn counterclockwise in FIG. 5 when outer cover 107 is opened, moving to the left in FIGS. 5 and 6*a* and 6*b*, and thus frees the hook lever 105 for clockwise movement when the outer cover 107 is opened, so that the hook lever 105 can be disengaged from the pin 106. FIG. 6 (*a*) shows the outer cover 107 in its opened position and the restraining plate 112 pivoted free of hook lever 105, and FIG. 6 (*b*) shows the parts in their positions when the outer cover 107 is closed.

Further with reference to FIGS. 3 and 4, the cleaner unit 6 of the copying machine 1 includes a blade member 61 in pressing contact with the photoconductive drum 2 to scrape residual toner off the drum surface after image transfer. When the photoconductive drum 2 is to be mounted or removed, the blade member 61 is preferably spaced from the drum 2 as already stated. For this purpose, the copying machine 1 incorporates a blade retracting mechanism to be described below.

The cleaner unit 6 will be described first with reference to FIGS. 7 to 9.

The cleaner unit 6 has opposite side plates 62 and 63 having recessed portions 62*a* and 63*a* for supporting the photoconductive drum 2, and the unit 6 is detachably mounted on the machine main body together with the drum 2.

The blade member 61 is held by holder means 65 pivotally mounted on a support rod 64 and biased at all times counterclockwise about the support rod 64 by a spring 68 attached to a pin 67 extending from the holder means and projecting outward from a casing 66.

The toner scraped off the photoconductive surface by the blade member 61 is collected in toner transport means 70 disposed below the blade member and discharged from the unit. The toner transport means 70 includes a transporting coil spring 71 and a coil casing 72 having a tubular channel with an inside diameter slightly larger than the outside diameter of the coil spring 71. The coil spring 71 discharges the toner from the unit when suitably rotated from outside the unit. The coil spring 71 may extend through a hose 73 connected to the developing unit 4 as seen in FIGS. 3 and 9 to return the toner to the unit 4 for reuse. The toner can be transported by the coil spring which extends from the interior of the cleaner unit 6 to the developing unit 4. Indicated at 74 and 75 are films for confining the toner into the transport means 70. The film 74 is about 50μ thick and has a free end in contact with the surface of the photoconductive drum 2. Little or no residual toner will be wiped off the photoconductive surface by the film 74, but the toner scraped off by the blade member 61 falls along the film 74 into the coil casing 72. The coil casing 72 has a lateral opening 72*a* with a width smaller than the outside diameter of the coil spring 71. This prevents the coil spring 71 from escaping from the casing and causing damage to the photoconductive surface or film 74 even if the spring 71 should be twisted or otherwise deformed.

The blade holder means 65 comprises a base 76 pivotally supported on the support rod 64 extending between the side plates 62 and 63, a support plate 78 pivotally mounted on the base 76 by a screw 77, a retainer plate 79 for holding the blade member 61 on the support plate 78 with the blade member positioned between the plates 78 and 79. The screw 77 is positioned approximately at the midportion of the support plate 78 in the direction parallel to the axis of the drum 2. The retainer plate 79 is pressed against and fastened to the support plate 78 by means such as screws (not shown) at the opposite ends thereof.

Using the cleaning device according to the present invention having the foregoing construction, the blade member must be set in position according to the following conditions.

Figure 1:
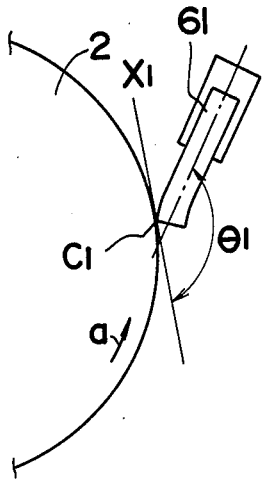
FIG.1 (Prior Art)
FIG. 1 is a diagram showing a conventional blade-type cleaning device in which the contact angle $\theta$ is an obtuse angle.
Figure 2:
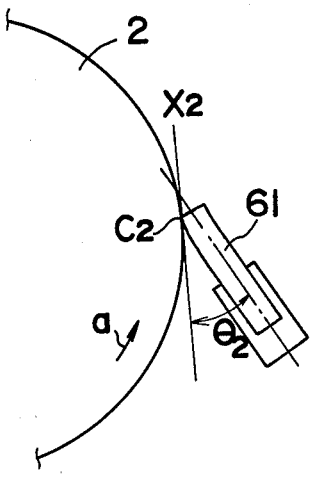
FIG.2 (Prior Art)
FIG. 2 is a diagram showing another conventional blade-type cleaning device in which the contact angle $\theta$ is an acute angle.

As already described with reference to FIG. 2, a blade-type cleaning device having an acute contact angle $\theta_2$ has the drawback that part of the toner may not be removed. Such incomplete cleaning takes place when the material, contact angle and contact pressure of the blade member and like mounting conditions are other than those specified. Experiments regarding these conditions have been conducted with the following results.

Figure 8:
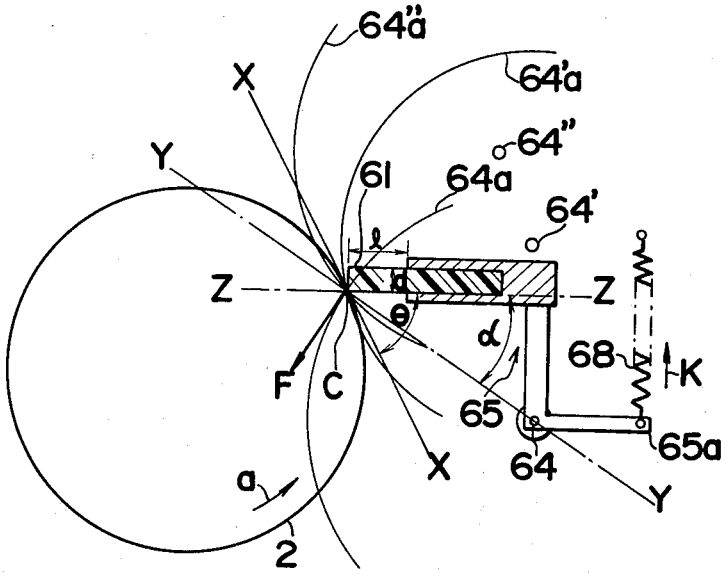
FIG. 8 is a schematic diagram useful for a detailed description of the construction of the blade-type cleaning device of the invention.

With reference to FIG. 8 schematically showing the blade-type cleaning device of the invention, the blade member 61 is held by the holder 65 pivotally mounted at the support point 64 and biased at an end 65*a* thereof by the spring 68 to hold the forward end of the blade member in pressing contact with the surface of the photoconductive member 2 with a force F. As previously stated, the contact angle of the blade member 61 thus positioned is the angle $\theta$ between a plane Z—Z along the blade member 61 and the portion of a tangent X—X to the drum through the point of contact C between the photoconductive drum 2 and the blade member 61, which portion extends on the side of the blade toward which the uncleaned portion of said drum is moving. The blade member 61 remains almost free from any deflection when the drum 2 is brought to a halt. The angle will be referred to as an "initial setting angle." The contact force F acts in a direction at right angles to a line Y—Y through the contact point C and the support point 64 of the holder 65.

The blade member 61 must be held in uniform pressing contact with the photoconductive surface and have sufficient ability to remove the toner to avoid incomplete cleaning. In this connection, the experiments revealed the following results:

(i) The larger the contact angle $\theta$ (approaching 90°), the greater is the ability of the blade member to remove the toner but the lower is the uniformity of contact since it becomes more difficult for the forward end of the blade member 61 to deform in conformity with the shape of the photoconductive member. Conversely the smaller the contact angle, the higher is the uniformity of contact but the greater is the deflection of the blade member 61 caused by a given contact force, with a tendency for the blade member to have a poorer ability to remove the toner. Because the use of a material of suitable hardness for the blade member 61 achieves some improvement in the uniformity of contact, as will be described below, the contact angle $\theta$ is preferably made as large as possible to achieve the best toner removing effect. The experiments have revealed that the contact angle $\theta$ is preferably in the range of $65° \leqq \theta \leqq 85°$. In the embodiment of FIG. 7, the contact angle $\theta$ shown is 75°.

(ii) With respect to the quality, especially the hardness H, of the material of the blade member 61, the harder the material, the greater is the toner removing ability, but too great a hardness tends to impair the uniformity of contact between the blade member and the photoconductive surface. For the best uniformity of contact for the above range of contact angles, it has been found that the hardness H should be in the range of $65 \text{ deg} \leqq H \leqq 78 \text{ deg}$ as determined by a durometer A in accordance with JIS K 6301. In the embodiment of FIG. 7, the hardness H is 73 deg.

(iii) When the contact angle $\theta$ and the hardness H are within the above described ranges, the proper range of the contact force F should be that which enables the blade member 61 to achieve sufficient toner removal and remain in uniform contact with the photoconductive surface without excessive deflection. It has been found that the contact force F is preferably in the range of $5 \text{ g wt.} \leqq F \leqq 11 \text{ g wt.}$ The provision of the proper range of contact forces is achieved by providing the proper thickness d of the blade member 61, the amount of projection l thereof from the holder 65, etc., and the blade member 61 preferably has a thickness d of 5 mm and projects an amount l of 19 mm based on the results of the experiments.

Further while the experiments have shown that the blade member 61 must have a hardness H sufficient to achieve the desired toner removal as already stated, it is critical that the spring 68 for holding the blade member 61 in pressing contact with the photoconductive surface have a modulus of elasticity K greater than the modulus of elasticity R of the blade member 61, for the following reason. The photoconductive member, must have a sufficiently high hardness to exert a force in a direction opposite the force tending to raise the blade member 61 when the toner tries to pass between the blade member 61 and the photoconductive surface. If $R > K$, the force would be absorbed by the deformation of the spring 68, and the entire blade member 61 would be raised, permitting passage of the toner. However if $R < K$, only portions of the toner will pass which overcome the resultant force of the blade member 61 and the blade member will not permit the passage of other portions of the toner.

In the foregoing it has been stated that the proper contact angle $\theta$ of the blade member 61 is in the range of $65° \leqq \theta \leqq 85°$. When the blade member 61 is held in pressing contact with the surface of the photoconductive member 2 at such a large angle by the holder 65 pivotally supported at the point 64 and biased counterclockwise in FIG. 8 at the holder end 65*a* by the spring 68, the position of the support point 64 is of importance.

FIG. 8 shows part of a circle 64*a* with its center at the support point 64 and having as its radius a line segment C-64 extending from the support point 64 to the contact point C between the blade member 61 and the drum 2. If the circle intersects the periphery of the drum 2 at a small angle, the blade member 61 will slip off the surface of the drum 2 due to its elasticity when the blade member is biased by the spring 68 or when the drum 2 rotates. This will be apparent when it is imagined the support point 64 being positioned at 64' or 64'' in FIG. 8. If the support point is located at the position 64', the circular arc 64'*a* through the contact point C intersects the circular periphery of the drum 2 at only a small angle, so that the blade member 61 will slip off the drum surface when biased with a large force counterclockwise by the spring around the support point 64'. Thus, the blade member 61, if supported at the point 64', is unable to exert a great contact force, failing to achieve a satisfactory cleaning effect.

If the support point is at 64'', the circular arc 64''*a* through the contact point C is also at a small angle to the circular periphery of the drum 2. Since the blade member 61 is biased clockwise, the direction in which the rotation of the drum 2 (in the direction of an arrow *a*) exerts a force on the blade member 61 coincides with the direction in which the blade member 61 is biased. Consequently the blade member 61 easily slips off the contact point when the drum is driven.

Accordingly when supported at the point 64' or 64'', the blade member 61 must be prevented from slipping off by a special means such as a stop. Extreme difficulty is encountered in achieving the desired cleaning effect.

In contrast, when the support point 64 is positioned in the same quadrant as the contact angle $\theta$ at an angle $\alpha$ of $0° \leqq \alpha \leqq 90°$ defined between the plane Z—Z of the blade member 61 and a line Y—Y through the contact point C and the support point 64 and toward the uncleaned portion of the drum 2 moving toward the blade, the circular arc 64*a* having the support point 64 as its center and extending through the contact point C is at a large angle to the circular periphery of the drum 2. Thus the blade member 61 will not slip off the contact point when biased counterclockwise about the support point 64. Theoretically, the angle $\alpha$ may be larger than 90°, but it is structurally difficult to provide an angle larger than 90°. With cleaning devices which must be a compact unit, the angle is preferably smaller than 90°. To provide a sufficient contact force, the angle $\alpha$ is preferably no smaller than 30°, in which case the blade member satisfactorily meets each of the requirements set forth above.

A mechanism for retracting the blade member 61 from the photoconductive drum 2 will not be described with reference to FIGS. 9 and 10. The blade retracting mechanism generally indicated at 200 comprises a slider plate 201 slidably supported on the side plate 62 of the cleaner unit 6, an L-shaped lever 202 pivoted on a pin 202*a* on the casing 66, a depressing member 204 pivotally connected by a pin 203 to a lower end 202*b* of the L-shaped lever 202 and slidably supported on pins on the casing 66, a spring 205 biasing the depressing member 204 in the direction of the arrow b at all times. The depressing member 204 has at its forward end a slanting cam face 204*a* which can be moved into bearing contact with the pin 67 on the holder 65 and to which the spring 68 is connected for normally holding the blade member 61 in pressing contact with the photoconductive surface.

Figure 9:
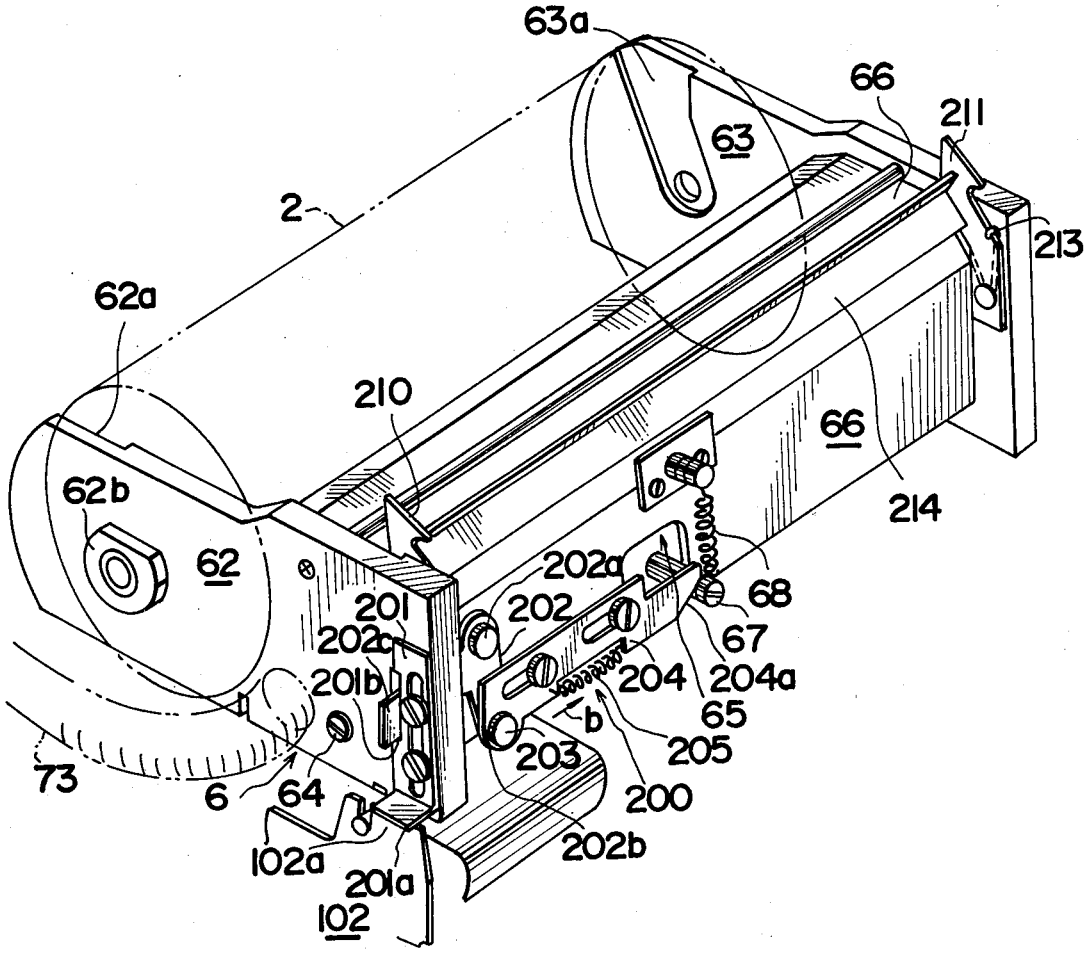
FIG. 9 is a perspective view showing the appearance of the cleaner unit and also a blade retracting mechanism.

When the upper frame 101 of the copying machine main body is in the closed position, i.e. pivoted clockwise against the lower frame 102, a lug 201*a* on the slider plate 201 is held in the raised position by a projection 102*a* on a portion of the lower frame 102 or fixed to the frame 102, as shown in FIG. 9. In this state, the end 202*c* of the L-shaped lever 202 in contact with a stepped portion 201*b* of the slider plate 201 is also held in a raised position. Consequently the lever 202 is turned clockwise in FIG. 9, pulling the depressing member 204 leftwardly against the action of the spring 205 and out of contact with pin 67. When the upper frame 101 is raised to the open position, the cleaner unit 6 is raised therewith, moving the slider plate 201 away from the projection 102*a*, so that it is no longer held in the raised position in which it has been retained by the projection 102*a*. The spring 205 therefore slides the depressing member 204 in the direction of the arrow b, advancing the cam face 204*a* into contact with the upper portion of the pin 67 and depressing the pin 67. The spring 205 of course is stronger than the spring 68.

Figure 7:
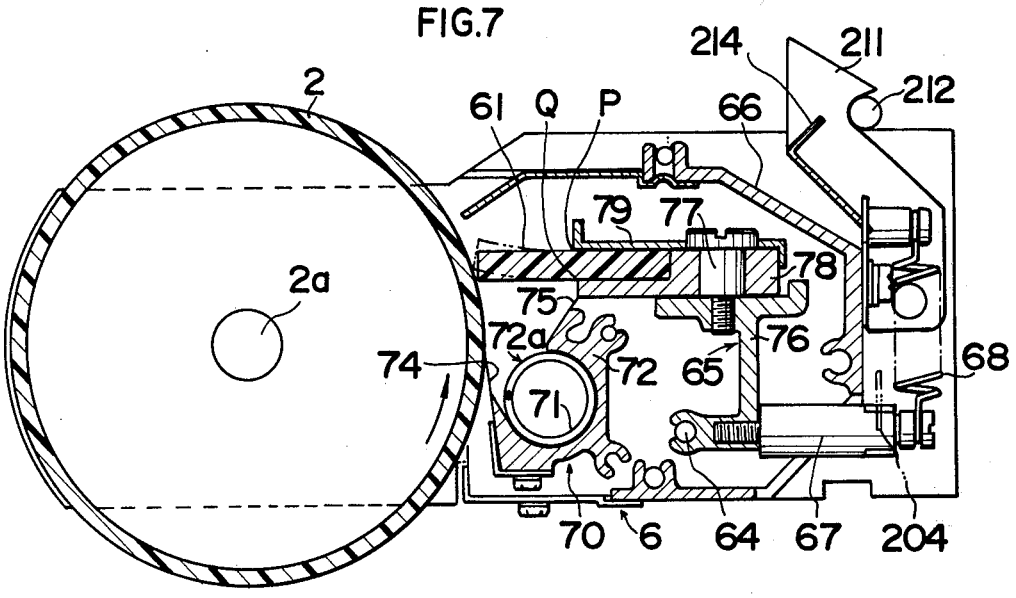
FIG. 7 is a sectional view showing the blade-type cleaning device according to the invention.

The depression of the pin 67 turns the blade holder means 65 clockwise in FIG. 7 around the support rod 64 and moves the blade member 61 out of contact with the surface of the drum 2.

Since the cleaner unit 6 and the drum 2 are removable from the machine body and installable therein with the upper frame 101 in the open position, the blade member 61, if spaced from the drum surface with the frames in this state, will not cause the troubles described above when the drum 2 is mounted or removed.

The hook levers 210 and 211 shown in FIGS. 7 and 9 are for locking the cleaner unit 6 to the upper frame 101 of the main body. The cleaner unit 6 is locked in position by fitting unillustrated bearing boss portions of the photoconductive drum 2 in the recessed portions 62*a* and 63*a* in the side plates 62 and 63 of the unit, then fitting projections 62*b* and 63*b* (not shown) on the unit 6 in support members (not shown) on the upper frame 101, and thereafter engaging the hook levers 210 and 211 with pins 212 fixed to the frame 101. The hook levers 210 and 211 are biased clockwise in FIG. 9 by torsion springs 213 at all times and are interconnected by an unlocking plate 214. The cleaner unit is unlocked by turning the hook levers 210 and 211 counterclockwise in FIG. 9 out of engagement with the pins 212 by urging the unlocking plate 214 counterclockwise.

Figure 10:
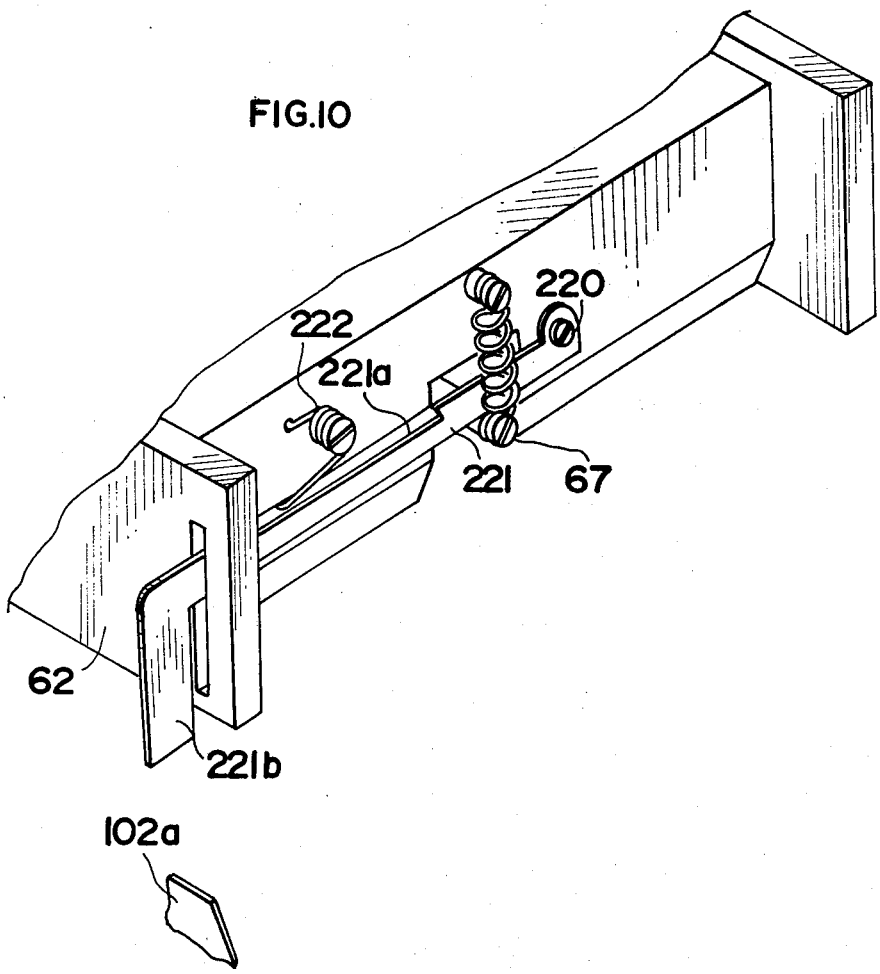
FIG. 10 is a perspective view showing another embodiment of the blade retracting mechanism.

FIG. 10 shows another blade retracting mechanism according to the invention. In this embodiment, a lever 221 pivotally supported on a pin 220 on the casing 66 contacts the pin 67 and has a bent portion 221*a* biased downward by a torsion spring 222. The lever 221 has a free end 221*b* projecting out through the side plate 62 and extending downward to contact the projection 102*a* on the lower frame 102 of the main body. When the upper frame 101 is in the closed position, the lever 221 is held in a raised position by the projection 102*a*.

When the upper frame 101 is raised, the cleaner unit 6 is raised therewith, freeing the lever 221 from the projection 102*a* and allowing the torsion spring 222 to depress the lever 221. The lever 221 depresses the pin 67 and retracts the blade member 61 from the surface of the drum 2.

To hold the blade member 61 in the holder means 65 in the cleaning device 6 described above, the blade member 61 is placed between the support plate 78 and the retainer plate 79 as seen in FIG. 7, and the support plate 78 and the retainer plate 79 are fastened together, for example by screws (not shown).

However, since a plurality of screws are used for fixing the blade member 61 arranged longitudinally on the member 61, the blade member 61 will be deformed to a wavelike shape longitudinally thereof if fastened by the screws with varying force or too tightly. Consequently the blade member 61 will be held in pressing contact with the photoconductive surface by an uneven force, possibly failing to achieve the desired cleaning effect.

Furthermore, the amount l the blade member 61 projects from the retainer plate 79, (see FIG. 8) greatly influences the cleaning effect and must therefore be set very accurately, whereas it is extremely difficult to set the blade member 61 in position, for example, when it is replaced, and innaccuracy is likely to result. Additionally it has been found that a rise in the interior temperature of the copying machine expands the blade member 61 and varies the amount l the blade projects. This phenomenon is unavoidable when screw fastening means are used.

As already described, the rotation of the photoconductive drum 2 causes deflection of the blade member 61 as illustrated by the broken line in FIG. 7. At this time, the blade member 61, which is firmly held by the retainer plate 79 and the support plate 78, is greatly influenced by the resulting deformation especially at the front end point P of the retainer plate 79 and the front end point Q of the support plate 78. If the blade member is allowed to stand or is continuously subjected to a dynamic load for a prolonged period of time, a permanent set will be produced in the blade member 61, adversely affecting the contact force with the surface of the drum 2 with the likelihood of impairing the cleaning effect.

Figure 11:
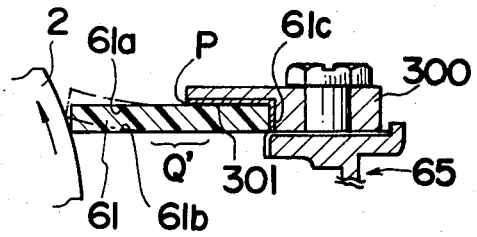
FIG. 11 is a view showing one manner of installing a blade member in the cleaning device.

To overcome these problems, the blade member 61 can have one side 61*a* adhered to a holding member 300 by an adhesive 301 as shown in FIG. 11.

When the blade member 61 is deflected as indicated by the broken line during the rotation of the drum 2, the blade member 61 is compressed on the side 61*a* and deformed by elongation on the other side 61*b* which is left substantially free.

The adhesive 301 need not have special properties as long as it is capable of holding the blade member 61 in position against the pull exerted thereon by the rotation of the drum 2 without chemically changing the properties of the blade member 61. A double-faced adhesive tape or the like can be used. The adhesive 301 may be applied to the rear end portion 61*c* of the blade member 61. The double-faced adhesive tape may be used in combination with some other adhesive.

When the blade member 61 is fixedly adhered to the holding member 300 in the manner described above, the blade member 61 can be dimensioned so as to fulfill the requirements such as the amount l the blade should project, as shown in FIG. 8, before adhesion to the holding member 300. The blade member 61 can therefore be easily and accurately mounted in position for installation and replacement. Since the side of the blade member 61 adhered to the holder is prevented from thermally expanding or contracting, the variations in the amount l the blade projects are reduced. Furthermore, the blade member 61, which is not subject to any external force such as a fastening force, will not be deformed to a wavelike shape longitudinally thereof, thus providing the desired cleaning effect.

In the blade member 61 shown in FIG. 7, marked deformation due to elongation takes place at the portion Q along the side 61*b*, whereas the blade member 61 shown in FIG. 11 is substantially free along the deformed area Q′ on the side 61*b* opposite to the point P on the compressed side 61*a*. Thus, deformation occurs over a larger area Q′ than in the FIG. 7 arrangement, and accordingly, the blade is less prone to permanent set.

We claim:

1. In an electrophotographic copying apparatus, an improved blade-type cleaning device comprising: an elastic blade member which is held in pressing contact with the surface of an electrophotographic photoconductive member for removing residual toner from the surface during movement of the photoconductive member;

holder means for holding the blade member, said holder means being turnable about a support point for bringing the blade member into or out of contact with the surface and holding said blade member when it is in contact with the surface positioned at an angle $\theta$ defined by $65° \leqq \theta \leqq 85°$ relative to the portion of a tangent to the surface through the point of contact between the blade member and the surface and which portion extends on the side of the blade toward which the uncleaned portion of said surface is moving, said support point lying on a line through said point of contact and on the same side of said blade as said tangent portion and which is at an angle $\alpha$ relative to said blade defined by $0° \leqq \alpha \leqq 90°$; and biasing means connected to said holder means for biasing said holder means to urge said blade member into contact with said surface.

2. A blade-type cleaning device as claimed in claim 1, in which said angle $\alpha$ is defined by $30° \leqq \alpha \leqq 90°$.

3. A blade-type cleaning device as claimed in claim 1, further comprising means connected to said holder means for retracting the blade member from the surface of photoconductive member against the biasing force of said biasing means when at least one part of said copying apparatus is moved.

4. An electrophotographic copying apparatus comprising:

a frame having upper and lower portions which are movable away from each other;

an electrophotographic photoconductive member mounted on said upper frame portion for being exposed when said upper frame portion is moved away from said lower frame portion to enable said member to be removed from said upper frame portion;

a blade-type cleaning device having an elastic blade member for contacting the surface of said electrophotographic photoconductive member for removing residual toner from said surface during movement of said member and a blade holder means holding said blade member and mounted on said upper frame portion for movement toward and away from the surface of said electrophotographic photoconductive member, and biasing means connected to said holder means for biasing said holder means to urge said blade member into contact with said surface when said frame portions are together; and retracting means connected to said cleaning device for retracting said holder means from said surface when said upper frame portion is moved away from said lower frame portion.

5. An electrophotographic copying apparatus as claimed in claim 4 in which said holder means is mounted on said upper frame portion for being turnable about a support point for bringing the blade member into or out of contact with the surface and holding said blade member when it is in contact with the surface positioned at an angle $\theta$ defined by $65° \leqq \theta \leqq 85°$ relative to the portion of a tangent to the surface through the point of contact between the blade member and the surface and which portion extends on the side of the blade toward which the uncleaned portion of said surface is moving, said support point lying on a line through said point of contact and on the same side of said blade as said tangent portion and which is at an angle $\alpha$ relative to said blade defined by $0° \leqq \alpha \leqq 90°$.

6. An electrophotographic copying apparatus as claimed in claim 4 in which said retracting means comprises lever means on said upper frame portion and engaging said holder means, said lever means being engagable with the lower frame portion when said frame portions are together for urging said lever out of contact with said holder means, whereby said biasing means biases said holder to urge said blade member into contact with said surface, and when said frame portions are moved apart said lever means is disengaged from said lower frame portion and engages said holder means for urging said holder means in a direction opposite to the direction in which said biasing means biases said holder means for moving said blade out of contact with said surface.

7. An electrophotographic copying apparatus as claimed in claim 6 in which said lever means is a slidable lever having further biasing means connected thereto urging said slidable lever toward said holder means for pivoting said holder means, and a crank means pivotally mounted on said upper frame portion and having one end pivotally connected to said slidable lever and having the other end engagable with said lower frame portion.

8. An electrophotographic copying apparatus as claimed in claim 6 in which said lever means is a pivotable lever pivotally mounted on said upper frame portion having one end engaged with said holder means for pivoting said holder means and having the other end engagable with said lower frame portion.

9. In an electrophotographic copying apparatus, an improved blade-type cleaning device comprising: an elastic blade member which is held in pressing contact with the surface of an electrophotographic photoconductive member for removing residual toner from the surface during movement of the photoconductive member;

holder means for holding the blade member, said holder means being turnable about a support point for bringing the blade member into or out of contact with the surface and holding said blade member when it is in contact with the surface positioned at an angle $\theta$ defined by $65° \leqq \theta \leqq 85°$ relative to the portion of a tangent to the surface through the point of contact between the blade member and the surface and which portion extends on the side of the blade toward which the uncleaned portion of said surface is moving, said support point lying on a line through said point of contact and on the same side of said blade as said tangent portion and which is at an angle $\alpha$ relative to said blade defined by $0° \leqq \alpha \leqq 90°$; and a spring member connected to said holder means for biasing said holder means to urge said blade member into contact with said surface, the elastic modulus of said spring member being larger than the elastic modulus of said blade member.

10. A blade-type cleaning device as claimed in claim 9, in which said angle $\alpha$ is defined by $30° \leqq \alpha \leqq 90°$.

11. A blade-type cleaning device as claimed in claim 9, further comprising means connected to said holder means for retracting the blade member from the surface of said photoconductive member against the biasing force of said spring member when at least one part of said copying apparatus is moved.

12. An electrophotographic copying apparatus comprising:

a frame having upper and lower portions which are movable away from each other;

an electrophotographic photoconductive member mounted on said upper frame portion for being exposed when said upper frame portion is moved away from said lower frame portion to enable said member to be removed from said upper frame portion;

a blade-type cleaning device having an elastic blade member for contacting the surface of said electrophotographic photoconductive member for removing residual toner from said surface during movement of said member and a blade holder means holding said blade member and mounted on said upper frame portion for movement toward and away from the surface of said electrophotographic photoconductive member, and a spring member connected to said holder means for biasing said holder means to urge said blade member into contact with said surface when said frame portions are together, the elastic modulus of said spring member being larger than the elastic modulus of said blade member; and retracting means connected to said cleaning device and said upper frame portion for retracting said holder means from said surface when said upper frame portion is moved away from said lower frame portion.

13. An electrophotographic copying apparatus as claimed in claim 12 in which said holder means is mounted on said upper frame portion for being turnable about a support point for bringing the blade member into or out of contact with the surface and holding said blade member when it is in contact with the surface positioned at an angle $\theta$ defined by $65° \leqq \theta \leqq 85°$ relative to the portion of a tangent to the surface through the point of contact between the blade member and the surface and which portion extends on the side of the blade toward which the uncleaned portion of said surface is moving, said support point lying on a line through said point of contact and on the same side of said blade as said tangent portion and which is at an angle $\alpha$ relative to said blade defined by $0° \leqq \alpha \leqq 90°$.

* * * * *